United States Patent [19]

Matsunaga et al.

[11] Patent Number: 4,621,493

[45] Date of Patent: Nov. 11, 1986

[54] SECONDARY AIR SUPPLY SYSTEM FOR INTERNAL COMBUSTION ENGINE

[75] Inventors: Yukuo Matsunaga, Ebina; Hajime Kawasaki, Yokohama, both of Japan

[73] Assignee: Nissan Motor Co., Ltd., Japan

[21] Appl. No.: 640,605

[22] Filed: Aug. 14, 1984

[30] Foreign Application Priority Data

Sep. 30, 1983 [JP] Japan ..... 58-183676

[51] Int. Cl.[4] ..... F01N 3/22

[52] U.S. Cl. ..... 60/290; 60/293; 74/860

[58] Field of Search ..... 60/293, 289, 290; 74/860

[56] References Cited

U.S. PATENT DOCUMENTS

| | | | |
|---|---|---|---|
| 3,971,212 | 7/1976 | Morita | 60/290 |
| 4,075,834 | 2/1978 | Saito | 60/290 |
| 4,098,079 | 7/1978 | Ueda | 60/290 |
| 4,270,347 | 6/1981 | Fukuba | 60/290 |
| 4,464,896 | 8/1984 | Kubota | 60/293 |
| 4,476,676 | 10/1984 | Ikenoya | 60/293 |
| 4,484,441 | 11/1984 | Kobayashi | 60/293 |

FOREIGN PATENT DOCUMENTS

| | | |
|---|---|---|
| 54-896 | 1/1979 | Japan . |
| 57-17050 | 4/1982 | Japan . |
| 2096487 | 3/1982 | United Kingdom . |

*Primary Examiner*—Douglas Hart
*Attorney, Agent, or Firm*—Lane and Aitken

[57] ABSTRACT

Admission of secondary air is effected to remove a portion of exhaust gases staying in components of a secondary air supply system, particularly, a one-way valve with a pair of lead valves. The scavenging with the secondary air is carried out when the fuel supply to the engine is suspended under a predetermined deceleration condition. When the predetermined deceleration condition is satisfied, a secondary air shut off valve is opened even when a coolant temperature of the engine is so high that the secondary air is not required by a catalyst in the exhaust system.

5 Claims, 2 Drawing Figures

SECONDARY AIR SUPPLY SYSTEM FOR INTERNAL COMBUSTION ENGINE

BACKGROUND OF THE INVENTION

The present invention relates to a secondary air supply system for an internal combustion engine of the type wherein a secondary air is admitted via a one-way valve by utilizing a pressure change created by exhaust pulsation within an exhaust system of the engine.

Japanese Utility Model Publication No. 54-896 discloses a secondary air supply system which has a secondary air shut off valve disposed in a secondary air passage upstream of a one-way valve in order to promote reaction within a catalytic converter in an exhaust system at low engine temperatures and to prevent over heating of catalyst and burning thereof at high engine temperatures. The shut off valve is opened to allow the admission of secondary air via the one-way valve at low engine temperatures, whereas it is closed to suspend the secondary air admission at high engine temperatures.

This arrangement suffers from a drawback that when the shut off valve is closed, a portion of the exhaust gases enters into a casing of the one-way valve and the secondary air passage downstream thereof, staying there for a relatively long time while the engine operates at high temperatures, and water component of the exhaust gases is condensed and causes a rust on the one-way valve and the secondary air passage.

Japanese Utility Model Publication No. 57-17050 discloses a secondary air supply system wherein a small aperture is formed through a valve member or a valve seat of a secondary air shut off valve that is disposed upstream of a one-way valve. With the provision of the small aperture, a small amount of secondary air continues to flow through the secondary air passage in order to scavange or remove the exhaust gases even when the shut off valve is closed. However, since the small amount of secondary air is always supplied, over heating of catalyst and afterburning are likely to take place.

SUMMARY OF THE INVENTION

An object of the present invention is to provide a secondary air supply system which can scavenge a secondary air supply passage with secondary air in order to prevent corrosion without causing over heating of catalyst and afterburning.

According to the present invention, a secondary air supply system is provided wherein the admission of secondary air is effected in order to scavenge a secondary air supply passage during a predetermined operating condition of an internal combustion engine when supply of fuel to the engine is suspended even when engine temperature fails to be lower than a predetermined value.

According to the present invention, a secondary air supply system for an internal combustion engine is provided. The engine includes an exhaust system and is provided with means for suspending supply of fuel to the engine when a predetermined deceleration condition of the engine is satisfied. The secondary air supply system comprises a source of secondary air, a one-way valve, a secondary air supply passage having one end communicating with the source of secondary air via the one-way valve and an opposite end communicating with the exhaust system of the engine, a secondary air shut off valve closing fluid flow communication between the one-way valve and the source of secondary air, a temperature sensor sensing a temperature of the engine, and a control unit for opening the secondary air shut off valve when the engine temperature is lower than a predetermined value and for opening the shut off valve when the predetermined deceleration condition of the engine is satisfied even when the engine temperature fails to be lower than the predetermined temperature.

DESCRIPTION OF THE PREFERRED EMBODIMENT

Figure 1:
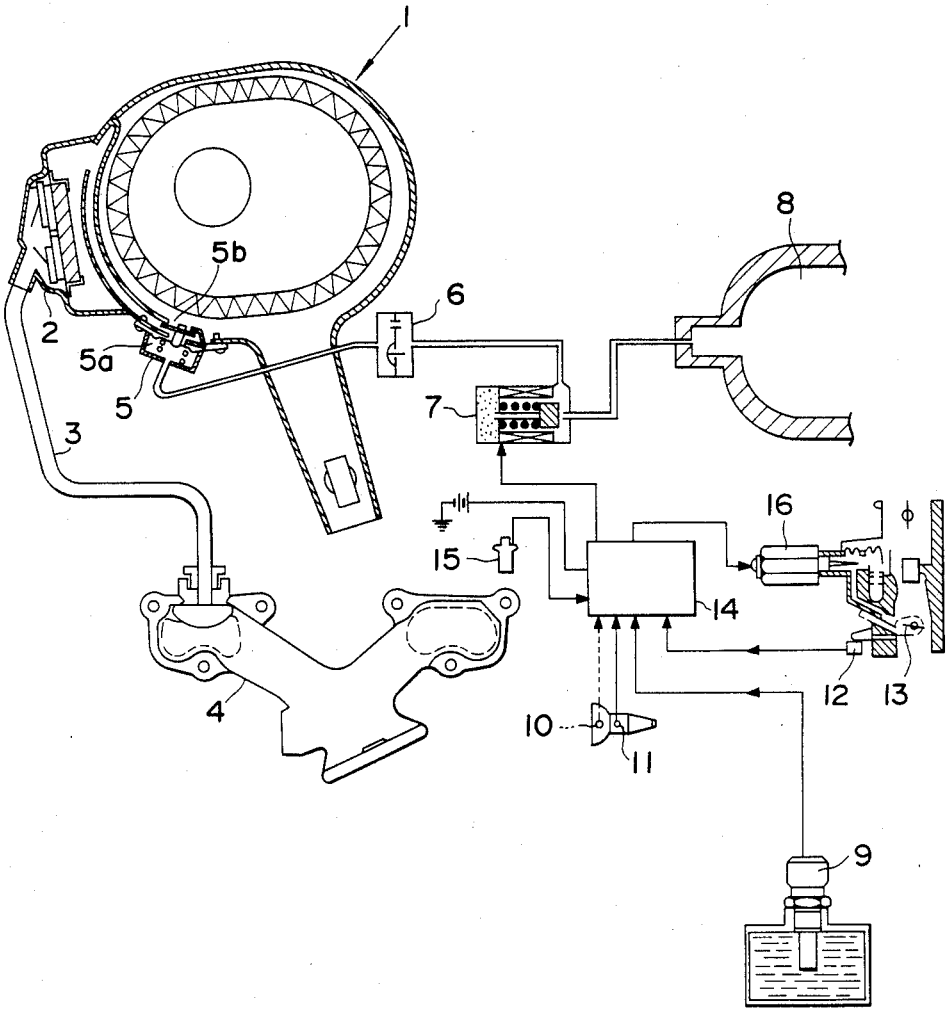
FIG. 1 is a schematic view of a secondary air supply system according to the present invention.

Referring to FIG. 1, the secondary air supply system comprises a source of secondary air in the form of an air cleaner 1 of an internal combustion engine. Attached to the air cleaner 1 is a one-way valve 2 including a pair of lead valves. A secondary air supply passage 3 has one end communicating via the one-way valve 2 with the air cleaner 1 and an opposite end communicating with an exhaust manifold 4 of the engine. A secondary air shut off valve 5 of a vacuum actuated spring biased diaphragm type is fluidly disposed within the air cleaner upstream of the one-way valve 2. The shut off valve 5 has a vacuum chamber 5*a* to which vacuum from a source of vacuum in the form of an intake manifold 8 or atmospheric air is selectively applied under the control of a solenoid valve 7. A delay valve 6 is disposed between the vacuum chamber 5*a* and the solenoid valve 7 in order to retard the admission timing of secondary air after the solenoid valve 7 has switched when a predetermined deceleration condition of the engine has been satisfied. If the solenoid valve 7 is opened, the vacuum is admitted to the vacuum chamber 5*a*, causing the shut off valve 5 to open a secondary air intake port 5*b*, while, if the solenoid valve 7 is closed, the atmospheric air is admitted to the vacuum chamber 5*a* and the secondary air intake port 5*b* is closed. The setting of the delay valve 6 is such that it provides an appropriate delay from the instance when the solenoid valve 7 is opened to the instance when the shut off valve 5 is opened. The appropriate delay ranges from 0.2 to 4 seconds which differs from one type of engines to another. This delay, however, does not take place when the selenoid valve 7 is closed due to a one-way function or valve of the delay valve 6.

A temperature sensor 9 is so mounted as to detect temperature of coolant passing through a coolant passage 9*a*. A clutch switch 10 is provided which detects interupption of a clutch in the case a transmission associated with the engine is a manual transmission coupled to the engine via a clutch. In the case the associated transmission is an automatic transmission, the clutch switch 10 is replaced with a neutral switch 11 which detects whether or not the automatic transmission is in neutral. A throttle valve switch 12 is provided which detects the fully closed condition of a throttle valve 13. Sensor output from the sensor 9 and outputs from switches are fed to a control unit 14. Engine revolution speed is detected by detecting frequency of ignition signals supplied to an ignition coil 15.

The engine is provided with a slow cut solenoid valve 16 which is energized when the predetermined deceleration condition of the engine is satisfied. The slow cut solenoid valve 16 is disposed in a slow fuel supply passage of a carburetor in a well known manner.

A deceleration fuel cut arrangement including the slow cut solenoid valve 16 is well known. Briefly explaining, when engine revolution speed (as obtained by detecting the frequency of ignition signals supplied to the ignition signals supplied to the ignition coil 15) is higher than a predetermined value and the throttle valve 13 is fully closed (as obtained by closure of the throttle valve switch 12), the slow cut solenoid solenoid 16 is energized, causing the slow fuel supply passage of a carburetor, thus suspending the supply of fuel to the engine.

Figure 2:
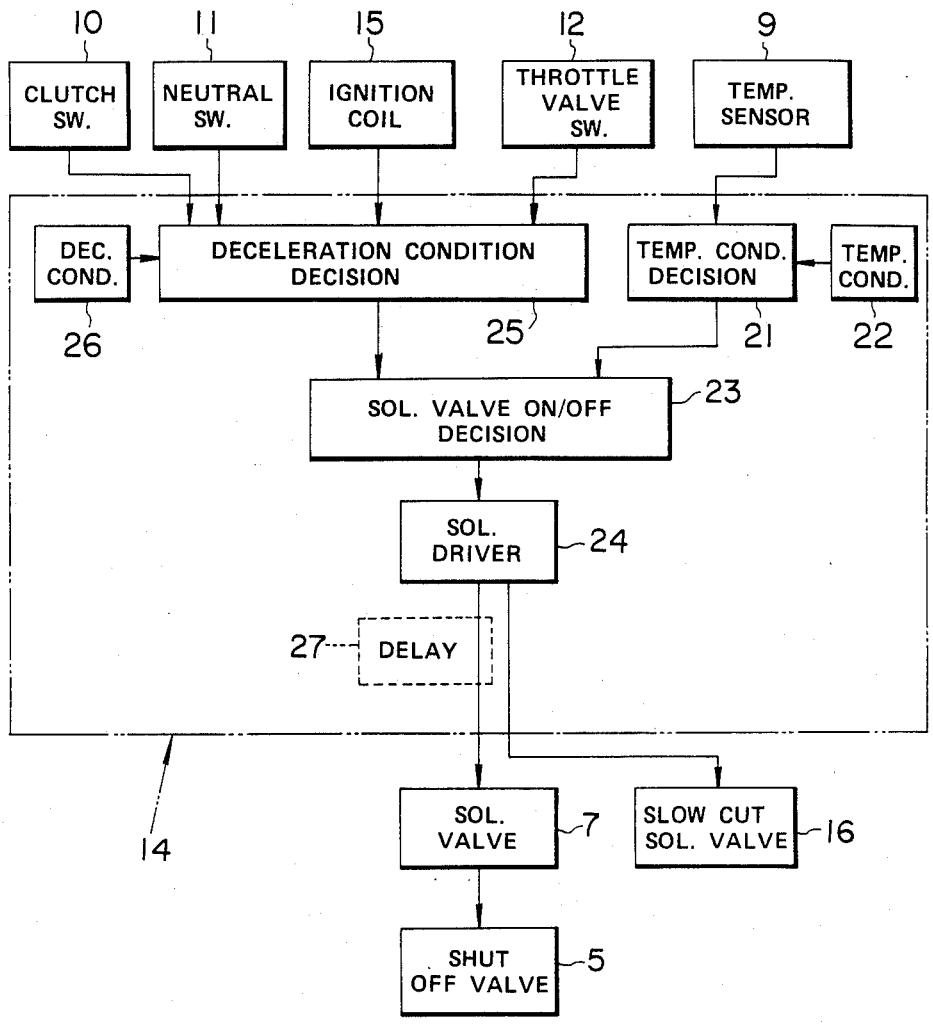
FIG. 2 is a block diagram illustrating how a control unit shown in FIG. 1 works.

Referring to FIG. 2, the above mentioned control unit 14 is illustrated in a block diagram. Describing the function of the control unit 14 referring to this block diagram, a sensed temperature by the temperature sensor 9 is compared in a temperature condition decision circuit 21 with a preset temperature. The preset temperature is stored in a portion 22 of a memory. When the sensed temperature is lower than the preset temperature, i.e., when the engine is cold, the solenoid valve 7 is energized or rendered ON because a solenoid valve ON/OFF decision circuit 23 instructs a solenoid driver 24 to open the secondary air shut off valve 5, thus permitting the admission of secondary air. When, on the other hand, the sensed temperature is higher than the preset temperature, i.e., when the engine is warm, the solenoid valve ON/OFF decision circuit 23 does not produce such an instruction, allowing the secondary air shut off valve 5 to assume its closed position under the bias of the spring, thus preventing the admission of secondary air.

However, even when the engine is warm, i.e., when the sensed temperature fails to be lower than the preset temperature, the admission of secondary air is effected when the above mentioned predetermined deceleration condition is satisfied, thus effecting scavenging with the secondary air. Based on engine revolution speed signal and throttle fully closed condition indicative signal from the throttle valve switch 12, a decision is made in the deceleration condition decision circuit 25 whether the detected deceleration condition satisfies the predetermined deceleration condition stored in another portion 26 of the memory. When the detected deceleration condition satisfies the predetermined deceleration condition, the solenoid valve 7 and the slow cut solenoid valve 16 are both rendered ON via the solenoid valve ON/OFF decision circuit 23 and solenoid driver 24. Thus, fuel supply is suspended and the admission of secondary air is initiated. Because of the admission of secondary air, the exhaust gases staying in the secondary air passage 3 and one-way valve 2 are immediately removed by the scavenging air. The admission of secondary air is terminated upon the release of the suspension of fuel supply, i.e., upon deenergization of the slow cut solenoid valve 16. Owing to the provision of the vacuum delay valve 6, the initiation timing of the admission of secondary air is slightly delayed from the timing when the fuel supply is suspensed. This delay is provided to ensure that the secondary air is admitted after the fuel adhered to the inner walls of the intake system has been discharged from the exhaust system, thus preventing afterburning from taking place. The vacuum delay valve 6 may be replaced with a delay circuit 27 which delays the transmission of the signal driver circuit 24 to the solenoid valve 7.

In order to prevent afterburning from taking place, the secondary air must not be admitted to the exhaust manifold during an instantaneous deceleration which would take place after engine racing during gear shifting in the transmission. When the interrupting state of the clutch in the case of the manual transmission or the neutral state in the case of the automatic transmission is detected by the clutch switch 10 or the neutral switch 11, the solenoid valve 7 is instructed to close the shut off valve 5, thus preventing the admission of secondary air.

When it is detected that the clutch is interrupted by means of the clutch switch 10 or the transmission is in neutral by means of the neutral switch 11, the solenoid valve 7 will not be opened even when the engine is under the predetermined deceleration condition and thus the secondary air is not admitted. This is to prevent the supply of secondary air to unburnt fuel component in the exhaust gases resulting from fuel adhered to the inner wall of the intake manifold. The fuel is apt to be adhered to the inner wall of the intake manifold during deceleration condition created after engine racing during gear shifting operation in the transmission.

It will now be appreciated that with the secondary air supply system wherein the admission of secondary air is effected in order to scavenging the secondary air supply passage when a predetermined engine decelerating condition is satisfied where the fuel supply is suspended, rust on the one-way valve due to the condensed water component of the exhaust gases, without bringing about overheating of catalyst and afterburning in the exhaust system.

What is claimed is:

1. A secondary air supply system for an internal combustion engine including an exhaust system, comprising:

means for suspending supply of fuel to the engine when a predetermined operating condition of the engine is satisfied;

a source of secondary air;

a one-way valve;

a secondary air supply passage having one end communicating with said source of secondary air via said one-way valve and an opposite end communicating with the exhaust system of the internal combustion engine;

a secondary air shut off valve closing fluid flow communication between said source of secondary air and said one-way valve;

a temperature sensor means for sensing temperature of the engine and generating a sensor output indicative of the sensed temperature; and a control unit including first means responsive to said sensor output for opening said secondary air shut off valve when said sensor output satisfies a predetermined temperature condition of the engine, and second means for opening said secondary air shut off valve when said predetermined operating condition of the engine is satisfied even when said predetermined temperature condition of the engine fails to be satisfied.

2. A secondary air supply system as claimed in claim 1, wherein said predetermined temperature condition of the engine is satisfied when the sensed temperature indicated by said sensor output is lower than a predetermined temperature value.

3. A secondary air supply system as claimed in claim 1, wherein said second opening means of said control unit includes delay means for opening said secondary air shut off valve upon elapse of a predetermined time after the predetermined operating condition of the engine has been satisfied.

4. A secondary air supply system for an internal combustion engine of an automotive vehicle having a transmission shiftable between various gears, comprising:

means for suspending supply of fuel to the engine when a predetermined deceleration condition of the engine is satisfied;

a source of secondary air;

a one-way valve;

a secondary air supply passage having one end communicating with said source of secondary air via said one-way valve and an opposite end communicating with the exhaust system of the internal combustion engine;

a secondary air shut off valve closing fluid flow communication between said source of secondary air and said one-way valve;

a temperature sensor means for sensing a representative temperature of the internal combustion engine and generating a sensor output indicative of the sensed coolant temperature;

a control unit including first means responsive to said sensor output for opening said secondary air shut off valve when the sensed temperature indicated by said sensor output is lower than a predetermined temperature value, and second means for opening said secondary air shut off valve when said predetermined deceleration condition of the internal combustion engine is satisfied even when the sensed temperature indicated by said sensor output fails to be lower than said predetermined temperature value.

5. A secondary air supply system as claimed in claim 4, wherein said control unit includes third means for overriding said second opening means of said control unit and closing said secondary air shut off valve when the transmission is in neutral state.

* * * * *